US005147120A

United States Patent [19]

Ray

[11] Patent Number: 5,147,120

[45] Date of Patent: Sep. 15, 1992

[54] STACKABLE BUREAU AND RACK FURNITURE

[76] Inventor: Frank J. Ray, 5340 Prospect St., Cocoa, Fla. 32926

[21] Appl. No.: 569,608

[22] Filed: Aug. 20, 1990

[51] Int. Cl.[5] ..... A47B 47/02

[52] U.S. Cl. ..... 312/111; 312/107; 312/195; 211/194

[58] Field of Search ..... 312/194, 195, 111, 107; 211/194; 108/91

[56] References Cited

U.S. PATENT DOCUMENTS

| | | | |
|---|---|---|---|
| 1,252,816 | 1/1918 | Kuehl | 108/91 V X |
| 2,612,590 | 9/1952 | Lachowicz | 312/107 X |
| 3,239,069 | 3/1966 | Hollins | 211/194 X |
| 4,128,063 | 12/1978 | Avery | 108/91 |

*Primary Examiner*—Joseph Falk
*Attorney, Agent, or Firm*—Edward M. Livingston

[57] ABSTRACT

Modular units (1, 11, 21, 24, 37 and 45) are stackable to form various types of multiple-unit bureaus, dressing tables, office desks and other types of drawer, shelf and rack furniture for rooms or closets. The modular units are single or multiple drawer, shelf or rack sections of furniture. Brace-legs (1) at corners (3–6) can be positioned sequentially, end-to-end vertically to position the bureau units firmly in a stack and to bear the load-weight of the drawers, shelves and cabinets together with contents on each with-out transmitting the load-weight to walls (7–9) of the bureau units.

32 Claims, 6 Drawing Sheets

STACKABLE BUREAU AND RACK FURNITURE

BACKGROUND OF THE INVENTION

This invention relates to furniture and more particularly to stackable drawer, shelf and rack bureau furniture for home and office use.

Furniture bureaus previously have been constructed in particular sizes for each multi-drawer or multiple-shelf unit. There have been no stackable modular units for customizing furniture for either home or office use. Moreover, no stackable drawer furniture exists which can be placed in closets to increase available space, especially important in small apartments.

Prior art teaches different types of modular construction but not modular or stackable bureau furniture. Typical of previous modular construction is U.S. Pat. No. 3,788,241 by Ravreby for a modular storage unit intended for storing shoes constructed by the structuring of walls in modular form for a storage unit. U.S. Pat. No. 4,688,687 by Pryor taught structure for optimizing closet storage space. U.S. Pat. No. 4,160,571 by Bigotti was rack structure for drawers in multiple-drawer bureau. Other patents too numerous and too different to mention teach different structure and working relationship of parts, but none like this stackable-module bureau and rack furniture.

SUMMARY OF THE INVENTION

One object of this invention is to provide low-cost furniture with advantages of modular construction.

A second object is to provide ease of moving and storage of the furniture.

Another object is facilitate customization of furniture at low cost.

A further object is to facilitate change of furniture design with change of the stacking relationships.

Even another object of this invention is to provide for increased availability of space in a particular room by allowing for storage in closets.

Modular bureau units are stackable to form various types of multiple-unit bureaus, dressing tables, office desks and other types of drawer, shelf and rack furniture. The modular units are single or multiple drawer, shelf or rack sections of furniture. Brace-legs at corners can be positioned sequentially, end-to-end vertically to position the bureau units firmly in a stack and to bear the load-weight of the drawers, shelves and cabinets together with contents on each without transmitting the load-weight to walls of the bureau units.

These and other objectives will be apparent from the appended descriptive claims and description of preferred embodiments in relation to the following drawings.

BRIEF DESCRIPTION OF THE DRAWINGS

This invention is described by claims in relation to a description of preferred embodiments illustrated in the following drawings in which:

DESCRIPTION OF THE PREFERRED EMBODIMENTS

Figure 1:
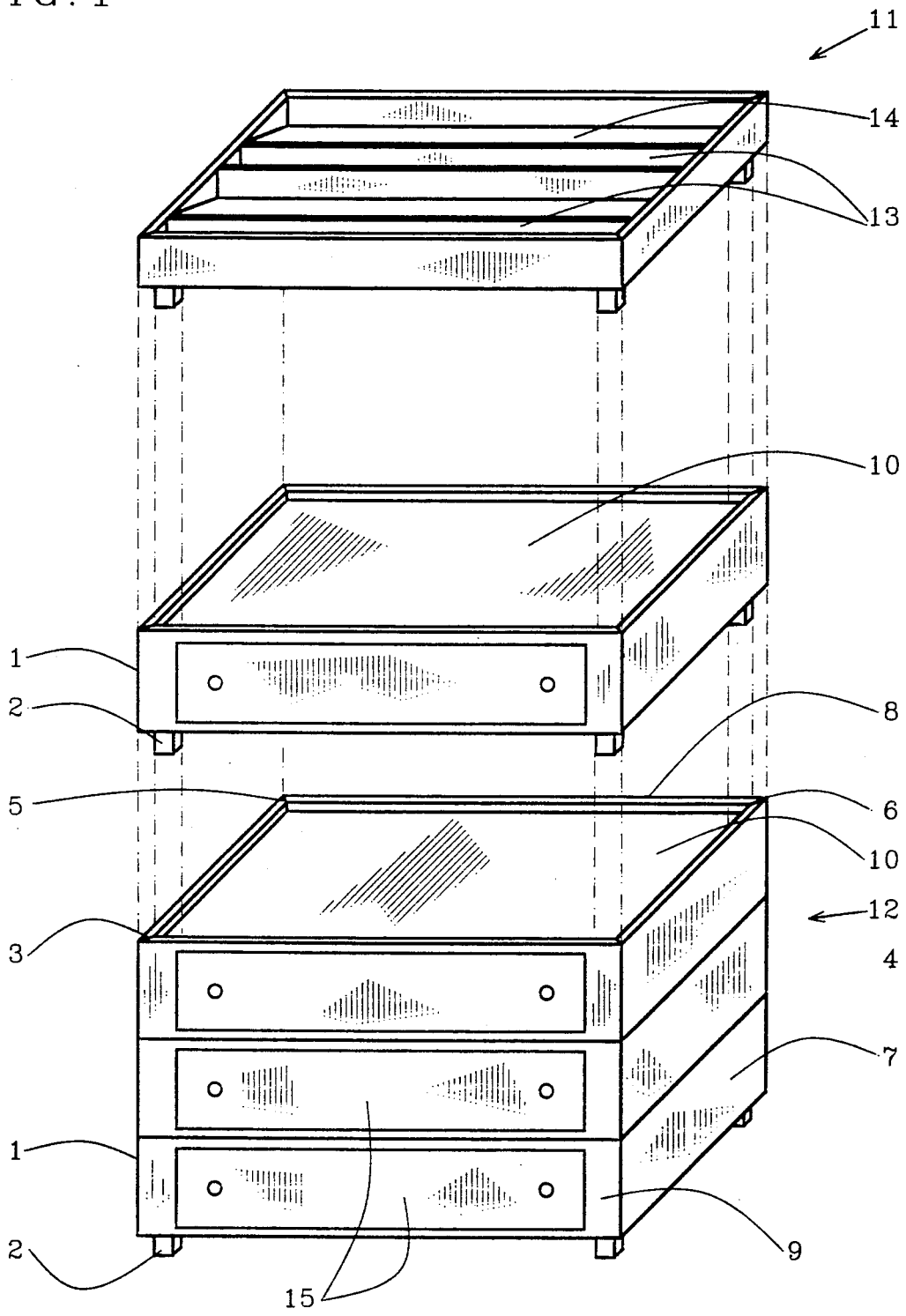
FIG. 1 is a perspective assembly front view of one embodiment of the invention comprising combination drawer bureau and shoe rack.

Referring to FIG. 1, modular drawer units 1 are stackable one on top of the other. Brace-legs 2 are extended a designated distance downward from inside of left-front corner 3, right front corner 4, left rear corner 5 and right rear corner 6 where side walls 7, rear wall 8 and front wall 9 are joined. An internal top 10 can be provided at the tops of the brace legs 2 but it is optional.

A shoe rack 11 can be placed at the top of a stack 12 and positioned with similar but preferably shorter brace-legs 2. The shoe rack 11 is provided with similar but typically shorter side walls 7 and rear walls 8 and front wall 9. The shoe rack can be provided with raised heel channel and slanted toe section 14.

Drawers 15 are insertable through the front wall 9.

The brace-legs 2 provide the multiple functions of positioning top units in bottom units, bracing the corners, bearing the low-weight of drawers separately from content load-weight and holding units above a floor as legs.

Figure 2:
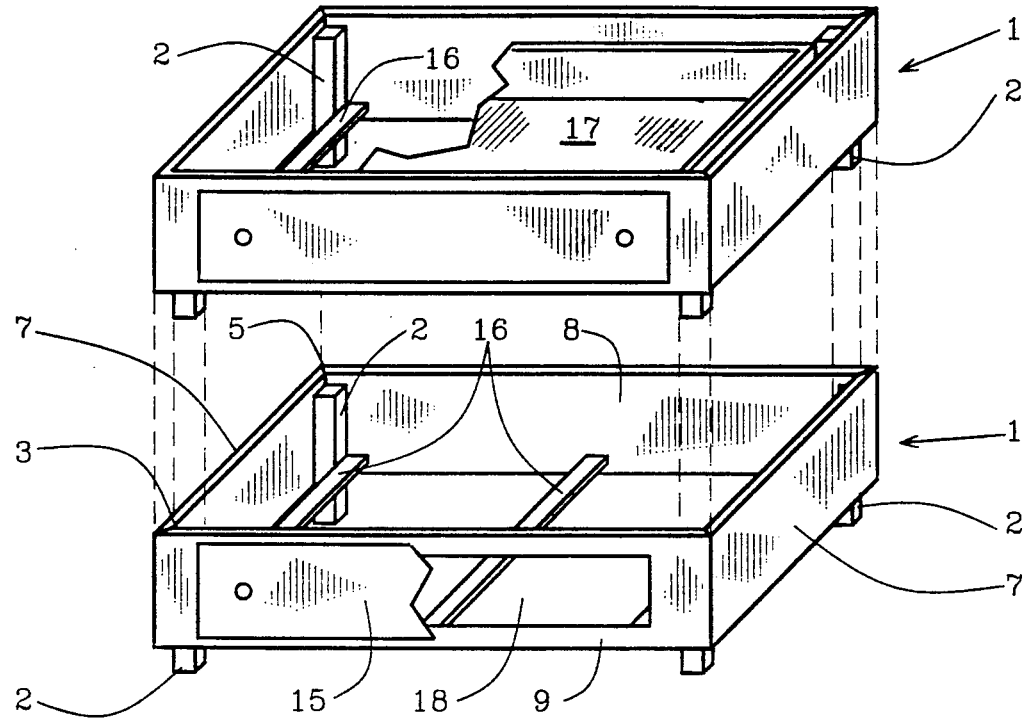
FIG. 2 is a partial cutaway perspective view of two units of the invention.

Referring to FIG. 2, drawer ways 16 can be attached to the brace-legs 2 at the sides of drawers. The drawer way 16 can be attached to front wall 9 and the rear wall 8 when not at the sides. The drawer ways 16 can be attached to both brace-legs 2 and to the walls 8 and 9 to increase rigidity when at the sides of units. A drawer-box bottom 17 can ride on the drawer ways 16. A drawer orifice 18 is provided at the front wall 9.

Figure 3:
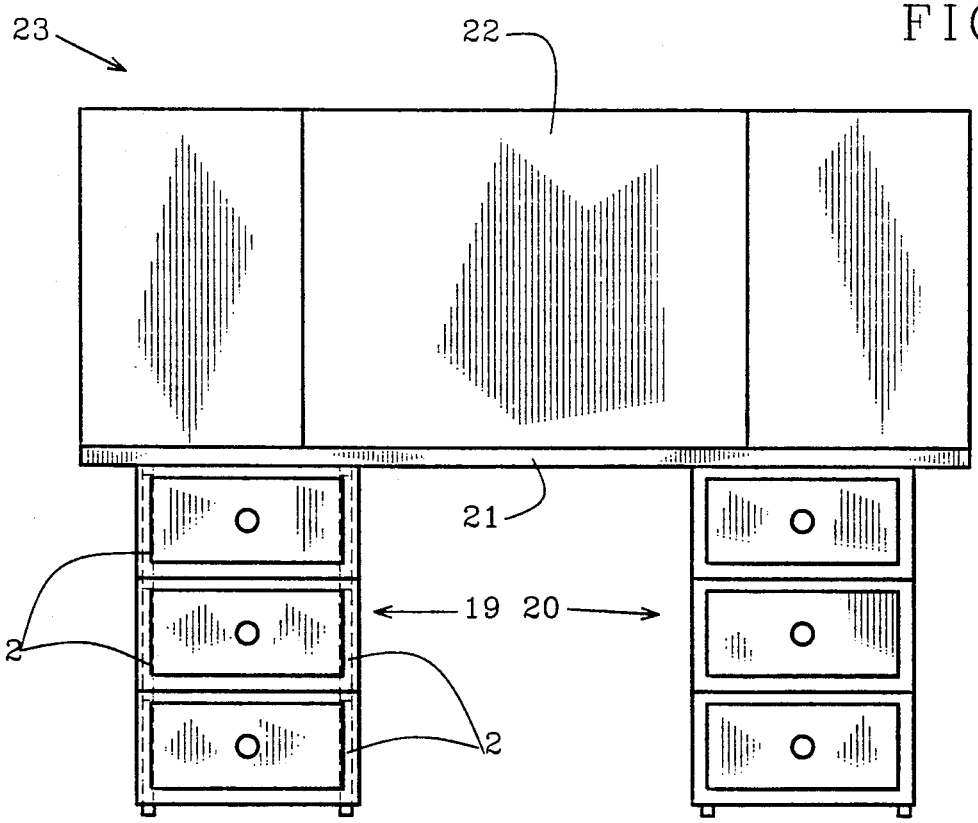
FIG. 3 is a front view of a dressing-table form of the invention.

Referring to FIG. 3, a left stack 19 and a right stack 20 of a plurality of stacks of modular drawer units 1 is provided with a modular top unit 21 and an optional three-way mirror 22 to form a customized dressing table 23. Illustrated in dashed line at both sides of the left stack 19 are columns of brace-legs 2 stacked within the front corners 3 and 4 from brace-legs 2 at the bottom unit 1 to the top unit 21. Further detail of this brace-leg 2 stacking relationship of parts is shown in FIGS. 1, 2, 6 and 14.

Figure 4:
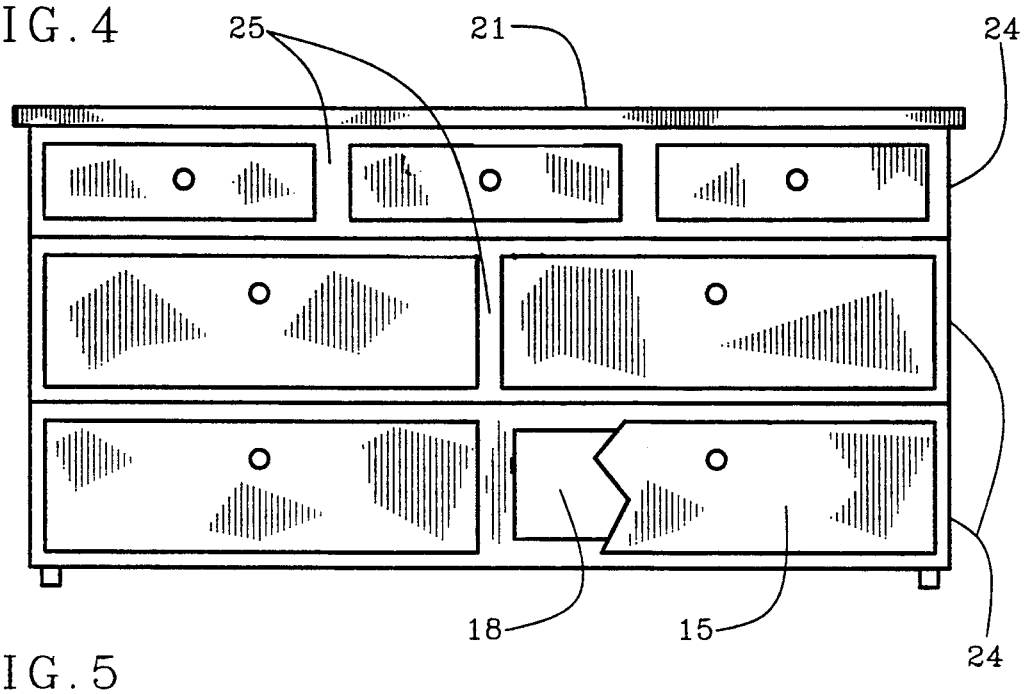
FIG. 4 is a cutaway front view of a stack of multiple-drawer units in the form of a drawer bureau.

Referring to FIG. 4, modular multiple-drawer units 24 are stacked in the form of a side-by-side drawer bureau 25 with modular top 21. Each modular multiple-drawer unit 24 is provided with drawer=divider sections 25 between drawer orifices 18 with drawers 15.

Figure 5:
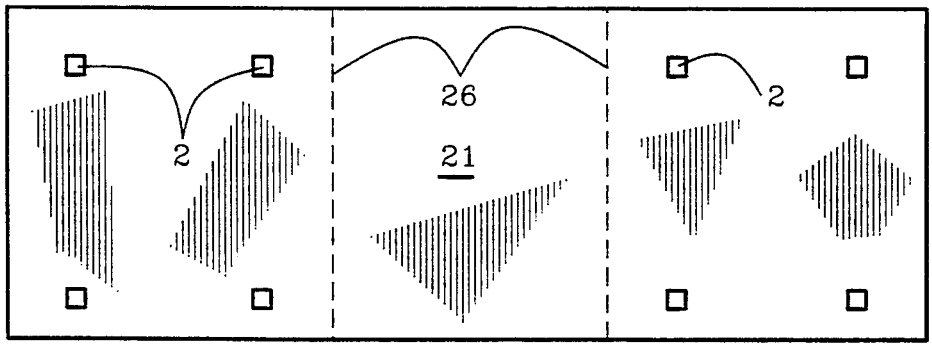
FIG. 5 is a bottom view of a top for a double-stack desk or dressing table.

Referring to FIG. 5, a modular top unit 21 is provided with brace-legs 2 which are insertable inside the corners of top modular units in stacks. For single stacks, such as illustrated in FIGS. 1, 4, 7, 11, 12, and 13, there would be only four brace-legs 4 as illustrated at each end of top unit 21. For a long single-stack top unit, therefore, only the two brace-legs 2 at each end of the top unit 21 would be attached and used.

Figure 6:
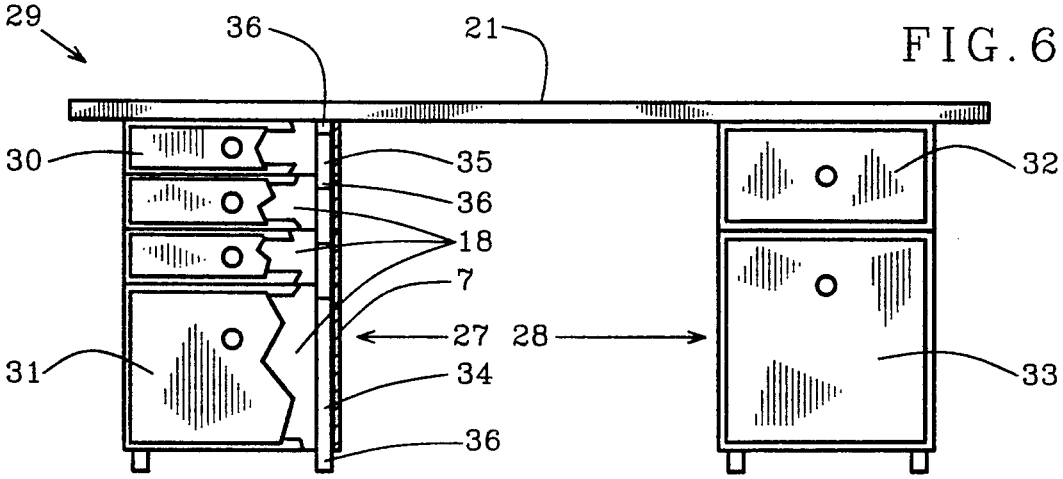
FIG. 6 is a cutaway front view of a double-stack desk or dressing table.

Referring to FIG. 6, a different left unit-height stack 27 and a different right unit-height stack 28 are provided with modular top unit 21 to form an office desk 29. The heights of modular units in each stack can be multiples of the height of the smallest unit. For example, top-left units 30 can be a minimum height of which all other unit heights are multiple. The bottom-left unit 31, therefore, is illustrated as being three times the height of unit 30. The height of top-right unit 32 is two times the height of unit 30 and the height of bottom-right unit 33 is four times the height of unit 30. This unitary relationship of heights provides equal stack heights for equal sums of units within relatively broad design parameters.

The length of brace-legs 34, 35 and 36 can be proportional to unit heights. For example, bottom-left brace-leg 34 a can be three times the length of top-left brace-leg 35 as illustrated in proportion to unit heights. A brace-leg for top-right unit 32 would be twice the length of brace-leg 35. A brace-leg height for bottom-right unit 33 would be four times the length of unitary brace-leg 35. For all lengths of brace-legs 1, a leg extension 36 is the same length. It is equal to the distance from top of a modular drawer unit 1 to the top of the brace-leg that a brace-leg is recessed. This same distance is the length of leg extensions 36 that function as legs below a stack. The length of a brace-leg 35 for a top unit can be as short as only the leg extensions 36. Conversely, the length of brace-legs in top units can be as great as the height of the top unit because there is no other unit that requires uniformity for equalization of height below the top unit. The brace-legs 1, 34 and 35 are positioned inside of side walls 7 and behind cutaway front wall 9 at a right-front corner 4 of a stack of units.

Figure 7:
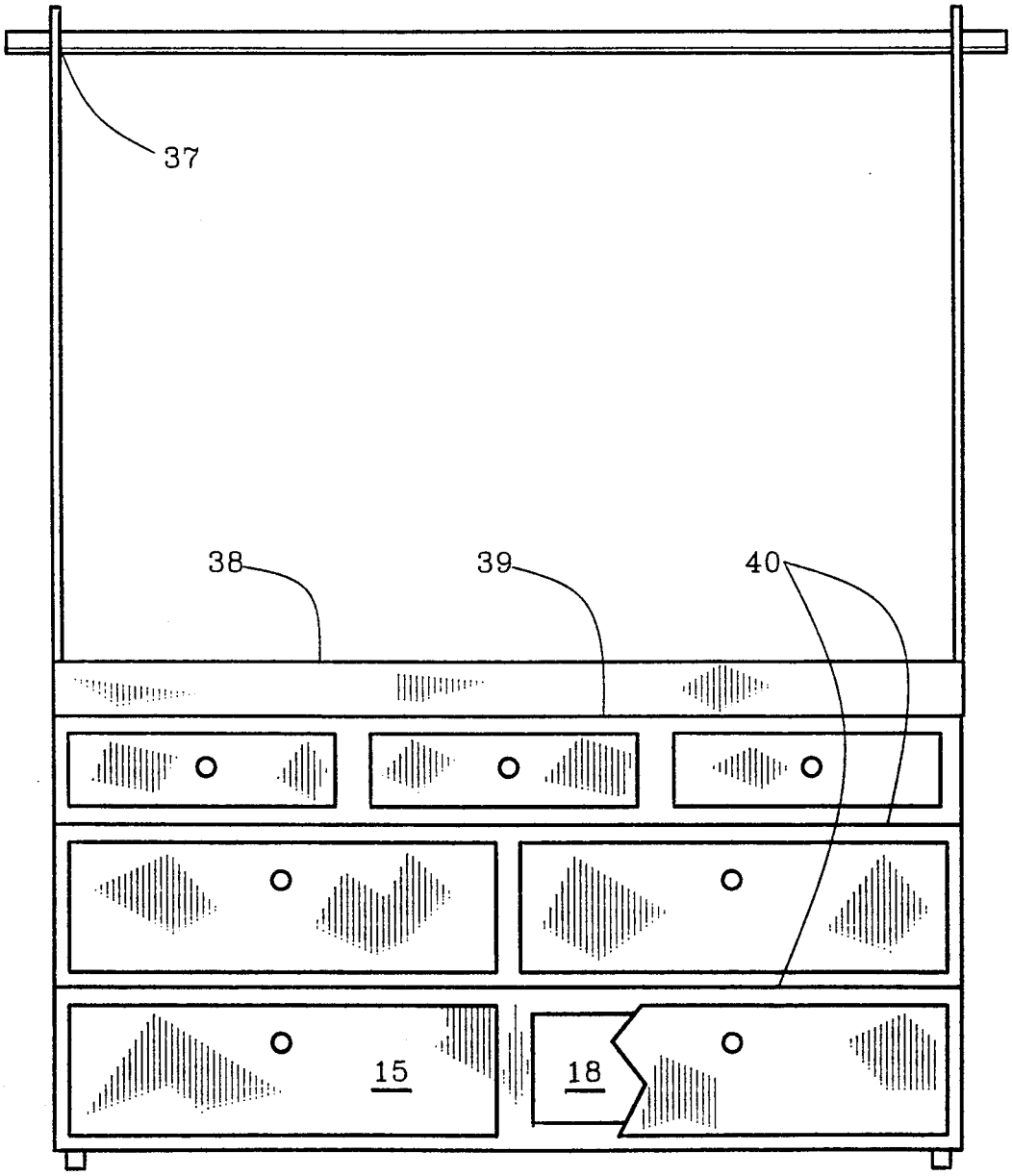
FIG. 7 is a cutaway front view of a stack of multiple-drawer units in the form of a drawer bureau with a clothes rack at the top.

Referring to FIG. 7, a clothes rack 37 can be extended above a clothes-rack base 38 at the top of a stack of modular units 1. The clothes-rack base 38 can function also as a top unit and as a shoe rack similar to the unit in FIG. 1. Alternatively, the base 38 can be flat like a table top or it can have walls to contain articles. The modular units can have a plurality of drawers or other storage spaces such as the three-drawer top unit 39 or the two two-drawer bottom units 40. A wide variety of combinations and arrangements of unit factors are foreseeable.

Figure 8:
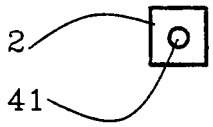
FIG. 8 is a bottom view of a brace-leg.

Referring to FIG. 8, the bottom end of a brace-leg 2 can be provided with an attachment orifice 41 for attaching casters, points, cushions or other floor-surface interface items. The shape of brace-leg 1 is preferably rectangular or triangular in order to provide a snug brace effect at corners of modular units. It is foreseeable that brace-legs 2 can be constructed in a wide variety of forms as substitutions of equivalents in order to minimize size. For instance, brace-leg 2 can be constructed in different shapes for top, bottom and central sections which can be the same or different materials for the rest of the brace-leg 2. They can be built into the inside of walls 7–9 at corners 3 6 as either part of the walls 7–9 or as separate materials. They can be high-strength material, such as metal or plastic, between a top and a bottom section, and wood or other attractive material at bottoms where seen as legs or where they connect with brace-legs 2 stacked above them. Attachments to the brace-legs 2 for protecting floors and floor coverings, can be placed on the outside or insertable into suitable orifices 41 in the brace-legs 2 as desired.

Figure 9:
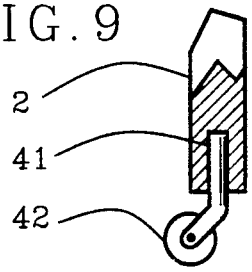
FIG. 9 is a cutaway sectional view of a brace-leg.

Referring to FIG. 9, an optional caster 42 can be inserted into the attachment orifice 41.

Figure 10:
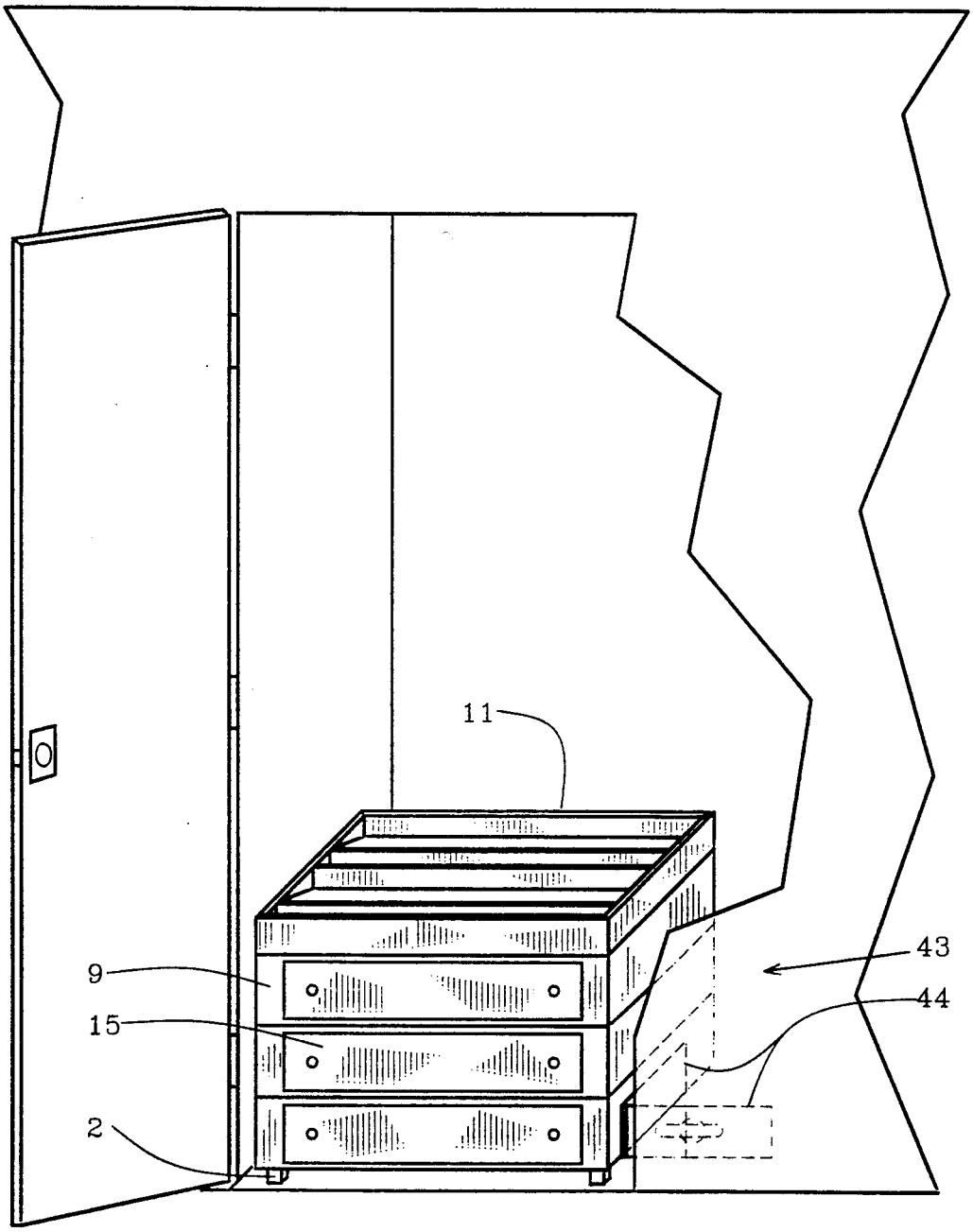
FIG. 10 is a perspective view of a drawer-stack unit with a shoe rack on top in a closet.

Referring to FIG. 10, a closet stack 43 of units 1 can be attachable to a wall of a closet with a hinged and slotted expander member 44 to facilitate movement for cleaning the closet. The expander member can be attachable to either or both sides of the stack. An easily hand-turnable nut, such as a knob or wing nut can be provided for ease of adjustment of the expander member. When used in a closet particularly, a shoe rack 11 can be utilized as the tip unit. The use of this closet stack 43 would fill up floor space in small apartments as foldable clothes could be stored in the closet stack drawers 15, shoes on the rack 11 and still have room in the closet for hanging clothes above the stack 43. Also, this unit is particularly suitable for yachts and motor homes where movement can cause furniture to move if it is not secured in place.

Figure 11:
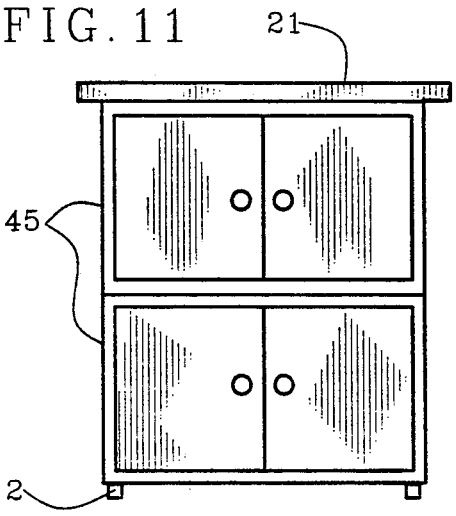
FIG. 11 is a front view of a multiple-shelf unit with doors and a top unit.

Referring to FIG. 11, modular door-bureau units 45 can be used in place of modular drawer units 1 with all of the same construction features. The doors can be single or double as illustrated.

Figure 12:
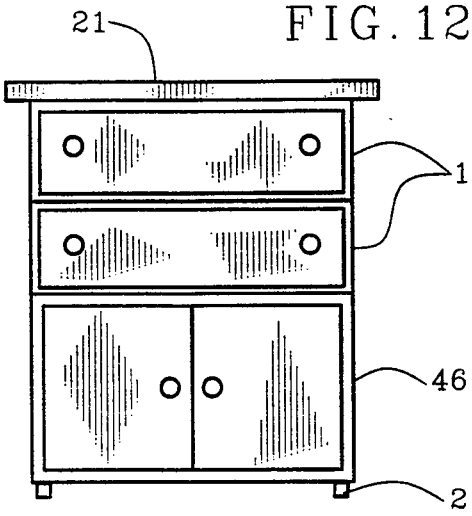
FIG. 12 is a front view of a combined shelf-and-drawer unit with a top unit.
Figure 13:
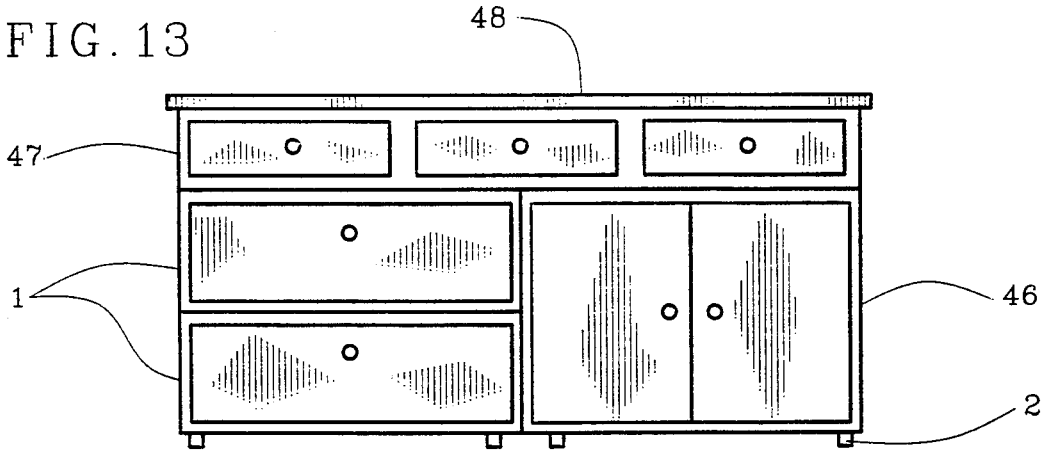
FIG. 13 is a front view of single door stack beside a double drawer stack with a single multiple-drawer-top.

Referring to FIG. 12, drawer units 1 can be used in combination with a plurality of stacks of shorter units as illustrated. The plurality of stacks can be separated or together as shown. Whether separated or together, the brace-legs of a suitably long top unit with or without container sections can be utilized to position and hold firmly the stacks in relation to the top unit. In this example, a single door unit 46 is coupled with a stack of two drawer units 1 that are the same total height. The coupling unit is a single three-drawer unit 47 topped by a relatively long single top unit 48.

Figure 14:
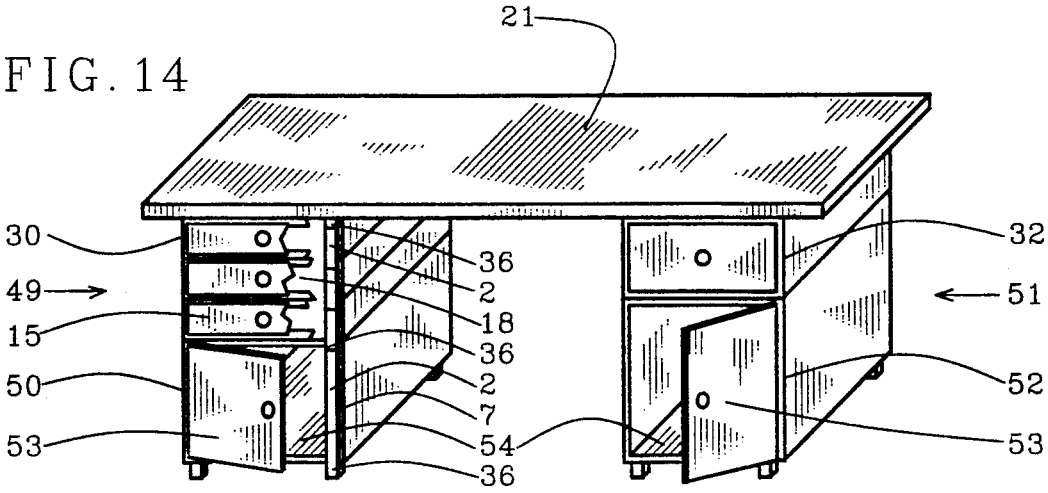
FIG. 14 is a double-stack unit with a combination of door and drawer units in each stack with a top in the form of a desk or dressing table.

Referring to FIG. 14, a left combination stack 49 is provided with a left-bottom shelf-and-door unit 50 that is three times the height of each of three drawer units 30. A right combination stack 51 is provided with a right-bottom shelf-and-door unit 52 that is twice the height of right-top unit 32 and four times the total height of unit 30. This is the same height relationship for combination stacks as for all-drawer stacks illustrated in FIG. 6. The same or similar height relationships and other dimensional relationships can be used for drawer units or any combination thereof.

Doors 53 are optional for shelf units, regardless of positional relationships. The use of doors 53 with shelf units is determined by the use-conditions. When doors 53 are not used, then shelves 54 are exposed without doors and the units becomes a form of open cupboard.

As discussed with reference to the drawings, a complete modular bureau furniture system is provided by this invention. All mathematical combinations of the components, all variations, all modifications and all applications of this invention foreseeable by description in the following claims as specified in the description of preferred embodiment and related drawings are included in this invention.

I claim:

1. A stackable bureau having:

two side walls, a rear wall and a front wall with top and bottom edges;

a drawer orifice in the front wall for a stackable drawer bureau;

a drawer slidable in and out of the bureau through the drawer orifice in the front wall;

a stack-positioning leg positioned at the front-corner juncture of the bottom edge of the inside surface of the front wall and each side wall as front legs and positioned at a rear-corner juncture of the bottom edge of the inside surface of the rear wall and each side wall as back legs; and a portion of each leg extendable from below the bottom edge of each wall at each corner to a position selectively above each bottom edge and below the top edge of each wall at each corner as corner braces in rigid contact with an inside wall at each corner, such that the legs are bureau-bottom legs and also bureau-positioning legs positionable within the top corners of a bottom bureau so formed from the bottom corners of a top bureau so formed.

2. A stackable bureau according to claim 1 wherein the portion of each leg extended as a corner brace is extended a sufficient distance above the bottom edge of each corner to contact a bottom of a leg of a second bureau so formed and stacked above a first bureau so formed with said legs positioned in each corner with weight of a plurality of bureaus so stacked being supported by sequentially-positioned brace-legs so formed.

3. A stackable bureau according to claim 1 and further comprising:

a stacking rim positionable selectively inward from and extendable a select distance from the bottom edge of each wall.

4. A stackable bureau according to claim 1 and further comprising a bureau top positionable within the inside periphery of the walls at a select distance from the top edge of the walls.

5. A stackable bureau according to claim 1 and further comprising:

a rack positionable within the inside periphery of the walls and supportable by the bureau.

6. A stackable bureau according to claim 5 wherein the rack is provided with support members that are supported by contact with sequentially-positioned brace-legs in contact with inside surfaces of the walls.

7. A stackable bureau according to claim 6 wherein the rack is a shoe-holder rack.

8. A stackable bureau according to claim 7 wherein the shoe rack is provided with a heel-holding member positioned parallel to and at a select distance rearwardly from a front wall of the said shoe rack and a select distance above a floor of the shoe rack.

9. A stackable bureau according to claim 5 wherein the rack is a clothes rack having support members supported by contact with sequentially-positioned brace-legs in contact with inside surfaces of the walls and select clothes-hanging members positioned above the support members.

10. A stackable bureau according to claim 1 and further comprising:

orifices in the bottoms of the legs for containing attachment appendages of casters, cushions, positioning points and other leg-bottom members.

11. A stackable bureau according to claim 2 and further comprising:

orifices in the bottoms of the brace-legs for containing attachment appendages of casters, cushions, positioning points and other leg-bottom members.

12. A stackable bureau according to claim 1 wherein the bureau is sized and shaped for fitting into and passing through door openings of select closets and other rooms.

13. A stackable bureau according to claim 12 and further comprising:

a slotted expander member attachable to a wall of a select room in which the bureau is positionable;

a matching slotted expander member attachable to a select wall of the bureau; and a bolt with an easily hand-turnable nut extended through the slots of each slotted member, such that the bureau can be moved conveniently in and out of the room on the expander member for cleaning the room and other purposes.

14. A stackable bureau according to claim 2 and further comprising:

a bureau top having a top surface positionable selectively above the top edges of the bureau walls and supportable by bureau-top legs extendable from the bottom of the bureau top to tops of the brace-legs.

15. A stackable bureau according to claim 2 wherein the bureau is sized and shaped for a side of a dressing table and further comprising:

a plurality of stackable bureaus in two stacks of equal height a select distance apart with front walls parallel and facing in the same direction; and a dressing-table top having four legs at the bottom of each end extendable to contact with tops of the brace-legs and in slidable contact with inside walls of corners of a top bureau so stacked.

16. A stackable bureau according to claim 15 and further comprising:

a dressing-table mirror positionable at a select position on top of the dressing table.

17. A stackable bureau according to claim 2 and further comprising:

a plurality of bureaus so formed and having selectively-different heights.

18. A stackable bureau according to claim 17 wherein the selectively-different heights are multiples of a common factor such that stacks of bureaus can be desired heights with different numbers of bureaus in the stacks.

19. A stackable bureau according to claim 17 wherein the bureaus are sized and shaped for an office desk with a desired height of stacks of bureaus at each end and an office-desk top and a desired combination of heights of bureaus in each stack and further comprising:

an office-desk top having four legs at the bottom of each end extendable to contact with tops of the brace-legs and in contact with inside walls of corners of a top bureau so stacked.

20. A stackable bureau according to claim 2 wherein the bureau is sized and shaped for a chest of drawers and further comprising:

a plurality of said bureaus stacked to a select height for a chest of drawers and further comprising:

a chest top having four legs at the bottom of each end extendable to contact with tops of the brace-legs and in contact with inside walls of corners of a top bureau so stacked.

21. A stackable bureau according to claim 2 and further comprising:

a plurality of drawer orifices and drawers slidable therein in the front wall of the bureau; and a plurality of selectively-different heights of multiple-drawer bureaus in multiples of a common factor such that stacks of the multiple drawer bureaus can be a desired height with different numbers of bureaus in the stacks.

22. A stackable bureau according to claim 21 and further comprising:

a stack of bureaus with selectively multiple drawers in select heights in a desired form of a chest of drawers; and a chest top having four legs at the bottom of each end extendable to contact with tops of the brace-legs and in contact with inside walls of corners of a top bureau so stacked.

23. A stackable bureau according to claim 2 and further comprising:

drawer ways attached to the brace-legs such that weight of drawers and the contents of drawers is supported by the brace-legs singularly and in columns of stacked bureaus having such brace-legs.

24. A stackable bureau according to claim 2 wherein the drawer ways are attached to the brace-legs and to a wall of the bureau such that the ways add structural rigidity.

25. A stackable bureau having:

two side walls, a rear wall and a front wall with top and bottom edges;

a door orifice in the front wall for a stackable door bureau;

a door in openable and closable relationship to the door orifice;

a shelf positioned internally from the walls at the bottom of the door orifice;

a stack-positioning leg positioned at a front corner juncture of the bottom edge of the inside surface of the front wall and each side wall as front legs and positioned at a rear-corner juncture of the bottom edge of the inside surface of the rear wall and each side wall as back legs; and a portion of each leg extendable from below the bottom edge of each wall at each corner to a position selectively above each bottom edge and below the top edge of each wall at each corner braces in rigid contact with an inside wall at each corner, such that the legs are bureau-bottom legs and also bureau-positioning legs positionable within top corners of a bottom bureau so formed from the bottom corners of a top bureau so formed.

26. A stackable bureau according to claim 25 wherein the portion of each leg extended as a corner brace is extended a sufficient distance above the bottom edge of each corner to contact a bottom of a leg of a second bureau so formed and stacked above a first bureau so formed with said legs positioned in each corner with weight of a plurality of bureaus so stacked being supported by sequentially-positioned brace-legs so formed.

27. A stackable bureau according to claim 26 and further comprising:

a stackable drawer bureau.

28. A stackable bureau according to claim 26 and further comprising:

a stack of selectively stackable drawer bureaus and door bureaus.

29. A stackable bureau according to claim 26 and further comprising:

a bureau top having a top surface positionable selectively above the top edges of the bureau walls and supportable by bureau-top legs extendable from the bottom of the bureau top to tops of the brace-legs of selectively drawer bureaus and door bureaus at the top of the plurality of stacks.

30. A stackable bureau according to claim 26 and further comprising:

a stack of selectively stackable drawer bureaus and door bureaus; and a bureau top having a top surface positionable selectively above the top edges of the bureau walls and supportable by bureau-top legs extendable form the bottom of the bureau top to tops of the brace-legs of the top bureau in the stack of bureaus.

31. A stackable bureau according to claim 25 wherein the door is removably mounted.

32. A stackable bureau according to claim 26 wherein the door is removably mounted.

* * * * *